US011050188B2

(12) United States Patent
Wu et al.

(10) Patent No.: US 11,050,188 B2
(45) Date of Patent: Jun. 29, 2021

(54) PLUG CONNECTOR ASSEMBLY

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Jerry Wu, Irvine, CA (US); Jun Chen, Kunshan (CN); Fan-Bo Meng, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/724,200

(22) Filed: Dec. 21, 2019

(65) Prior Publication Data

US 2020/0203886 A1 Jun. 25, 2020

(30) Foreign Application Priority Data

Dec. 21, 2018 (CN) ..... 201811570116.3

(51) Int. Cl.
*H01R 12/62* (2011.01)
*H01R 13/627* (2006.01)
*H01R 13/66* (2006.01)

(52) U.S. Cl.
CPC ..... *H01R 13/6272* (2013.01); *H01R 12/62* (2013.01); *H01R 13/665* (2013.01)

(58) Field of Classification Search
CPC .. H01R 27/00; H01R 13/502; H01R 13/6275; H01R 13/639; H01R 13/641; H01R 2107/00; H01R 31/06; H01R 12/523; H01R 12/53; H01R 12/7011; H01R 12/7017; H01R 12/7023; H01R 12/724; H01R 12/75; H01R 12/772; H01R 12/79; H01R 13/08; H01R 13/10; H01R 13/113; H01R 13/20; H01R 13/26; H01R 13/35; H01R 13/44; H01R 13/501; H01R 13/506; H01R 13/5829; H01R 13/62; H01R 13/6205; H01R 13/6272; H01R 13/6277; H01R 13/6278; H01R 13/6315; H01R 13/635; H01R 13/6582; H01R 13/6587; H01R 13/6597; H01R 13/6683; H01R 13/703; H01R 2105/00; H01R 2201/12;

(Continued)

(56) References Cited

U.S. PATENT DOCUMENTS 4,337,989 A 7/1982 Asick et al.
5,486,117 A * 1/1996 Chang ..... H01R 13/6275 439/353

(Continued)

FOREIGN PATENT DOCUMENTS

CN 1076785613 5/2017
CN 304332784 10/2017
CN 208209042 12/2018

*Primary Examiner* — Truc T Nguyen
(74) *Attorney, Agent, or Firm* — Ming Chieh Chang; Wei Te Chung

(57) ABSTRACT

In a plug connector assembly, a plug connector for mating with a receptacle connector, includes: a shell and a locking spring mounted on the shell and including a mating curved surface for directly locking to and unlocking from a receptacle connector.

9 Claims, 9 Drawing Sheets

(58) Field of Classification Search
CPC ..... H01R 24/58; H01R 24/60; H01R 24/64; H01R 31/065; H01R 43/26
See application file for complete search history.

(56) References Cited

U.S. PATENT DOCUMENTS

| | | | | |
|---|---|---|---|---|
| 6,508,660 | B2 | 1/2003 | Self | |
| 6,592,398 | B2 * | 7/2003 | Kashiyama | H01R 13/641 439/188 |
| 7,083,459 | B1 * | 8/2006 | Wu | H01R 13/6275 439/354 |
| 7,192,297 | B1 * | 3/2007 | Wu | H01R 12/592 439/358 |
| 7,762,852 | B2 * | 7/2010 | Daly | H01R 13/748 439/638 |
| 7,794,262 | B2 * | 9/2010 | Briant | H01R 13/6275 439/352 |
| 7,828,598 | B2 * | 11/2010 | Wang | H01R 13/65802 439/607.27 |
| 7,841,889 | B2 * | 11/2010 | Gerard | H01R 13/6272 439/358 |
| 9,263,831 | B2 * | 2/2016 | Shen | H01R 13/6272 |
| 9,419,362 | B2 * | 8/2016 | Lin | H01R 13/193 |
| 10,886,649 | B1 * | 1/2021 | Yang | H01R 13/6273 |
| 2005/0101176 | A1 * | 5/2005 | Kachlic | H01R 13/6275 439/352 |
| 2013/0052851 | A1 * | 2/2013 | Wang | H01R 13/6275 439/345 |
| 2019/0173232 | A1 | 6/2019 | Lu et al. | |

* cited by examiner

PLUG CONNECTOR ASSEMBLY

BACKGROUND OF THE DISCLOSURE

1. Field of the Disclosure

The present disclosure relates to a plug connector assembly, in particular to a plug connector convenient to insert and pull with regard to the plug connector assembly.

2. Description of Related Arts

China Patent No. CN3047525725, issued on Jul. 31, 2018, discloses a cable connector which includes a shell, a printed circuit board received in the shell, a cable electrically connected to the printed circuit board, and a locking spring. The shell includes an upper casing and a lower casing cooperating with the upper casing, and the locking spring is mounted on the upper casing.

Because the locking spring is a push-type structure, the locking spring must be pressed to unlock the receptacle connector, which is inconvenient to use.

Therefore, an improved plug connector is desired.

SUMMARY OF THE DISCLOSURE

Accordingly, an object of the present disclosure is to provide a plug connector convenient to insert and pull.

To achieve the above object, a plug connector for mating with a receptacle connector, comprises: a shell; and a locking spring mounted on the shell and including a mating curved surface for directly locking to and unlocking from a receptacle connector Other objects, advantages and novel features of the disclosure will become more apparent from the following detailed description when taken in conjunction with the accompanying drawings.

DETAILED DESCRIPTION OF THE PREFERRED EMBODIMENT

Figure 1:
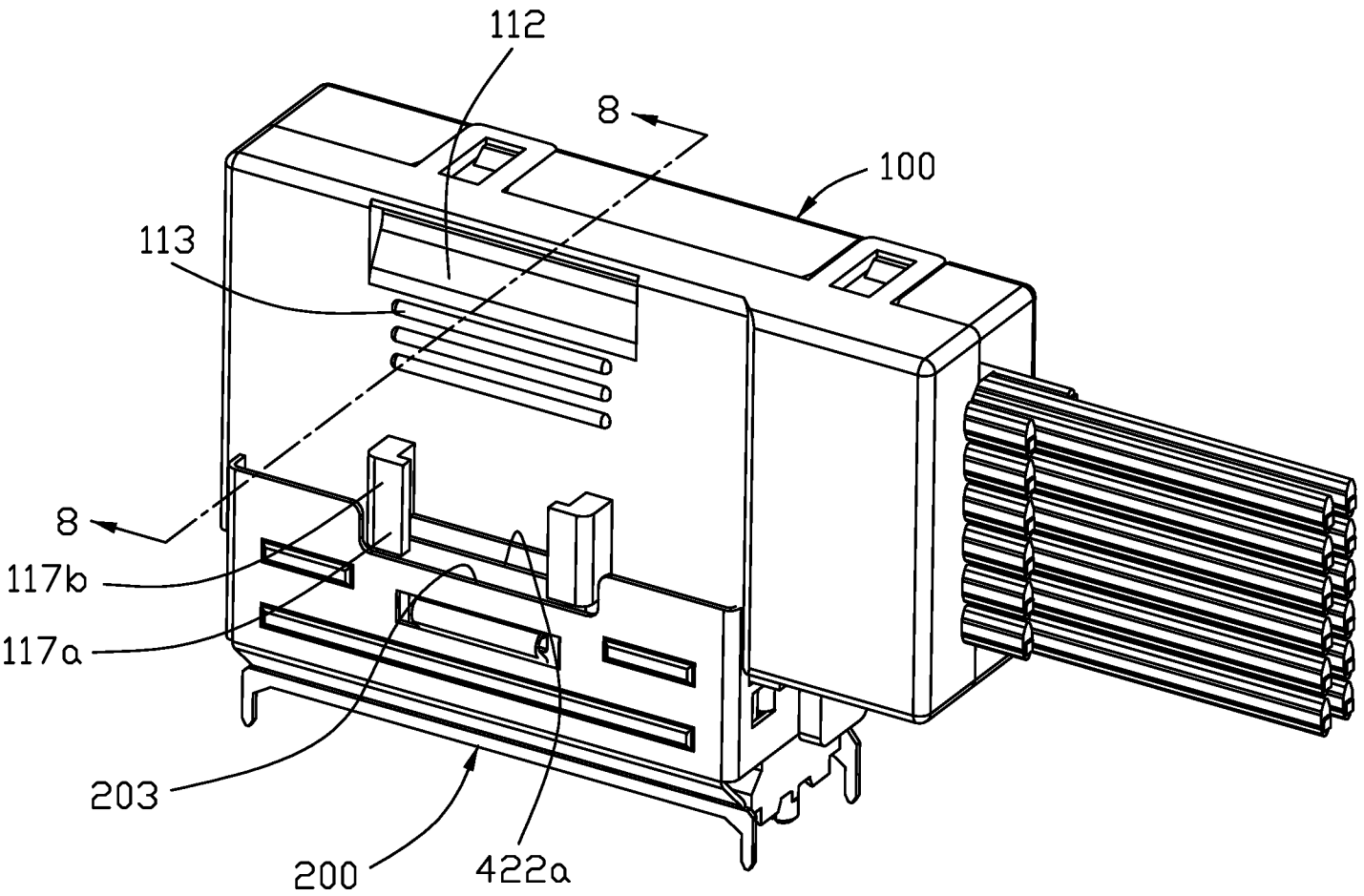
FIG. 1 is a perspective view of a plug connector is mated with a receptacle connector according to the present invention.
Figure 2:
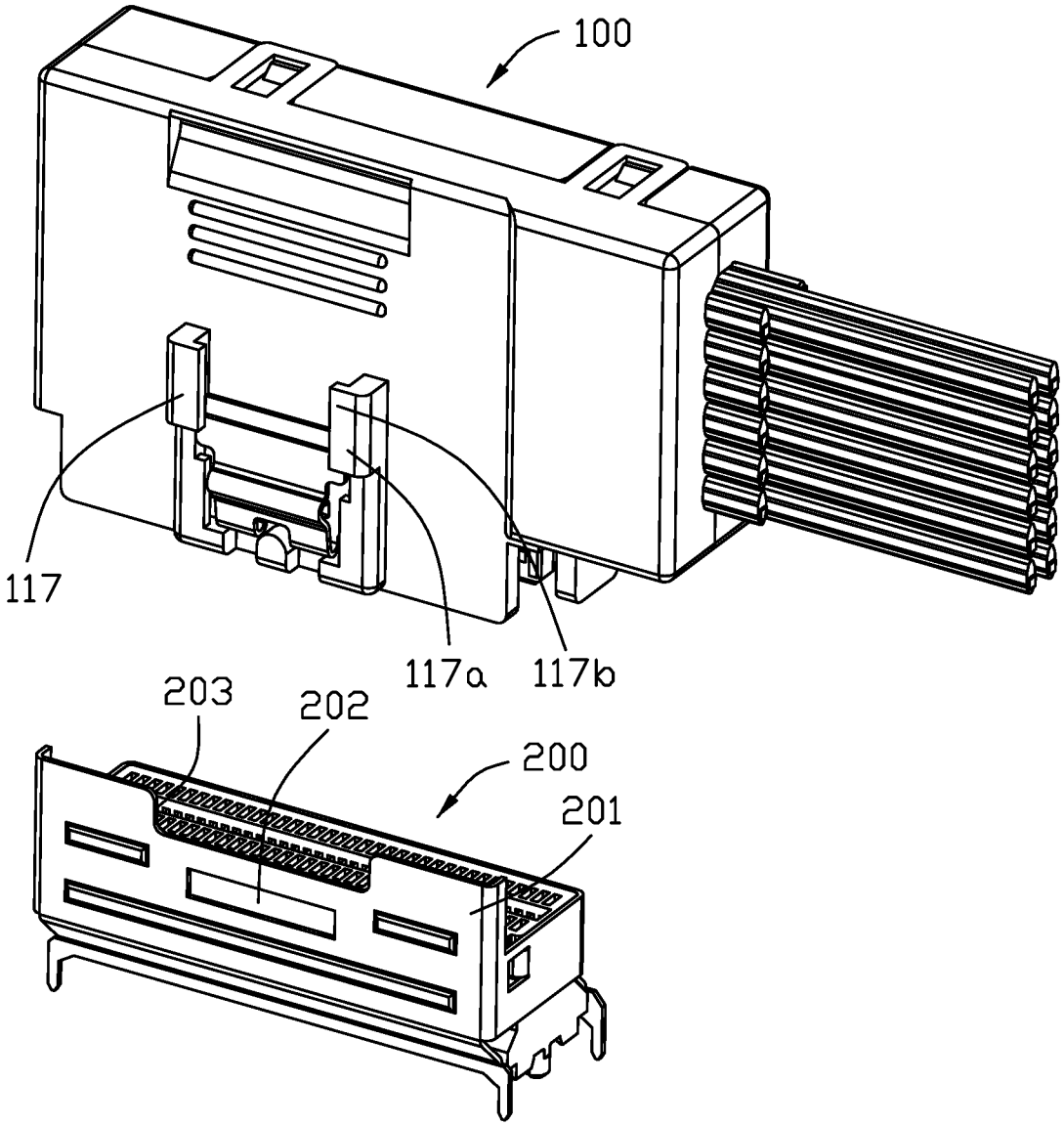
FIG. 2 is a perspective view of the plug connector is not mated with the receptacle connector as shown in FIG. 1.
Figure 3:
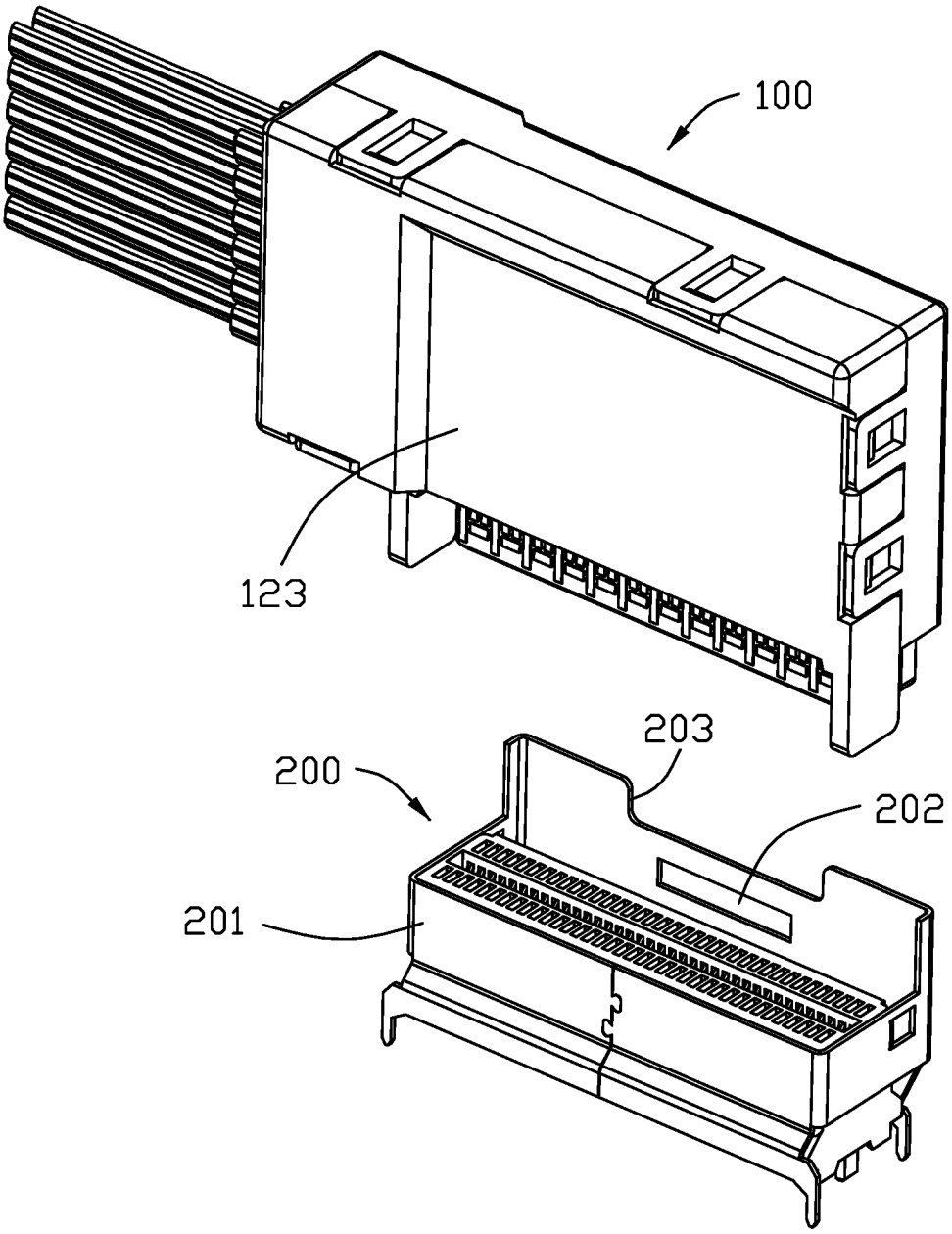
FIG. 3 is another perspective view of the plug connector is not mated with the receptacle connector as shown in FIG. 2.
Figure 4:
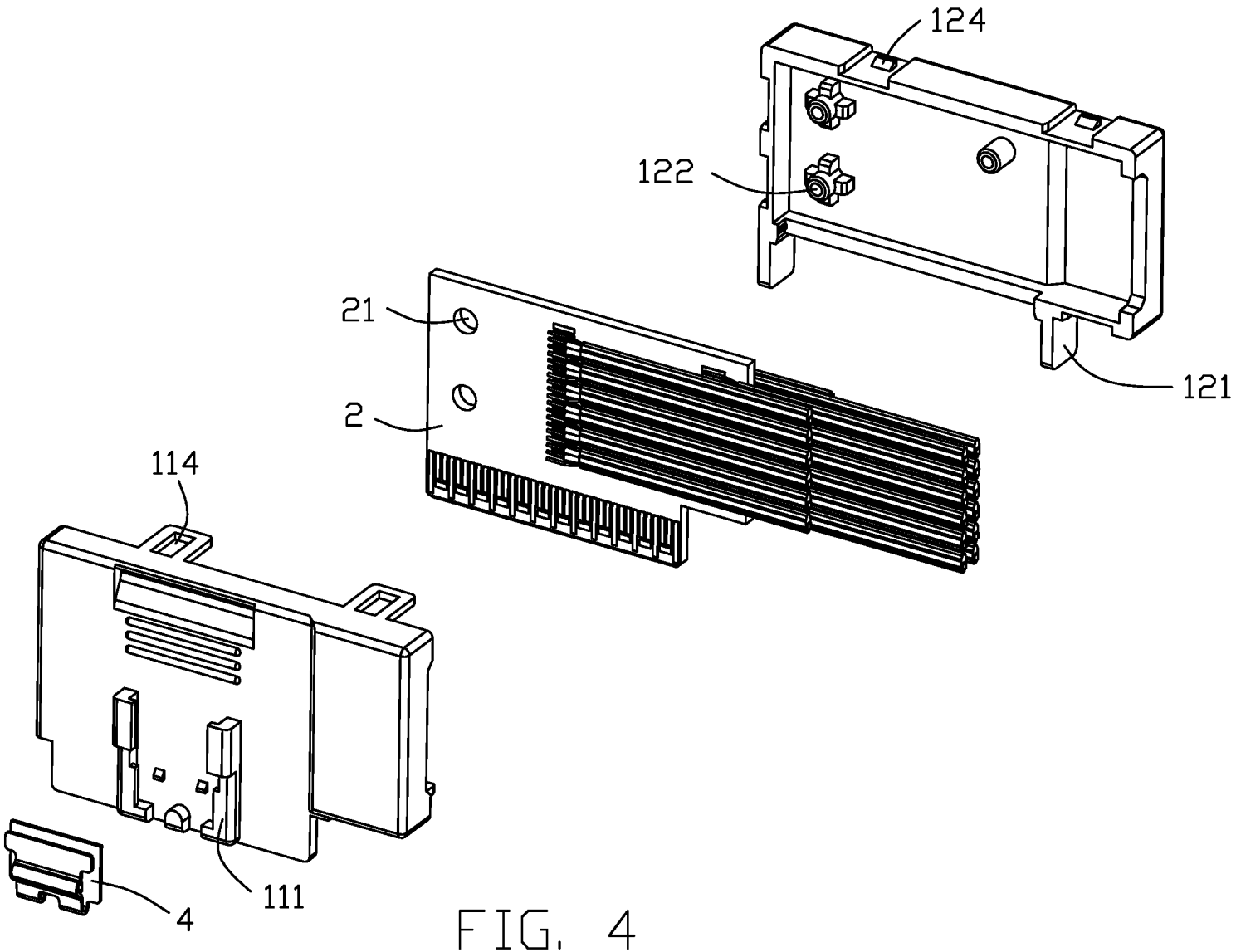
FIG. 4 is an exploded view of the plug connector as shown in FIG. 2.
Figure 5:
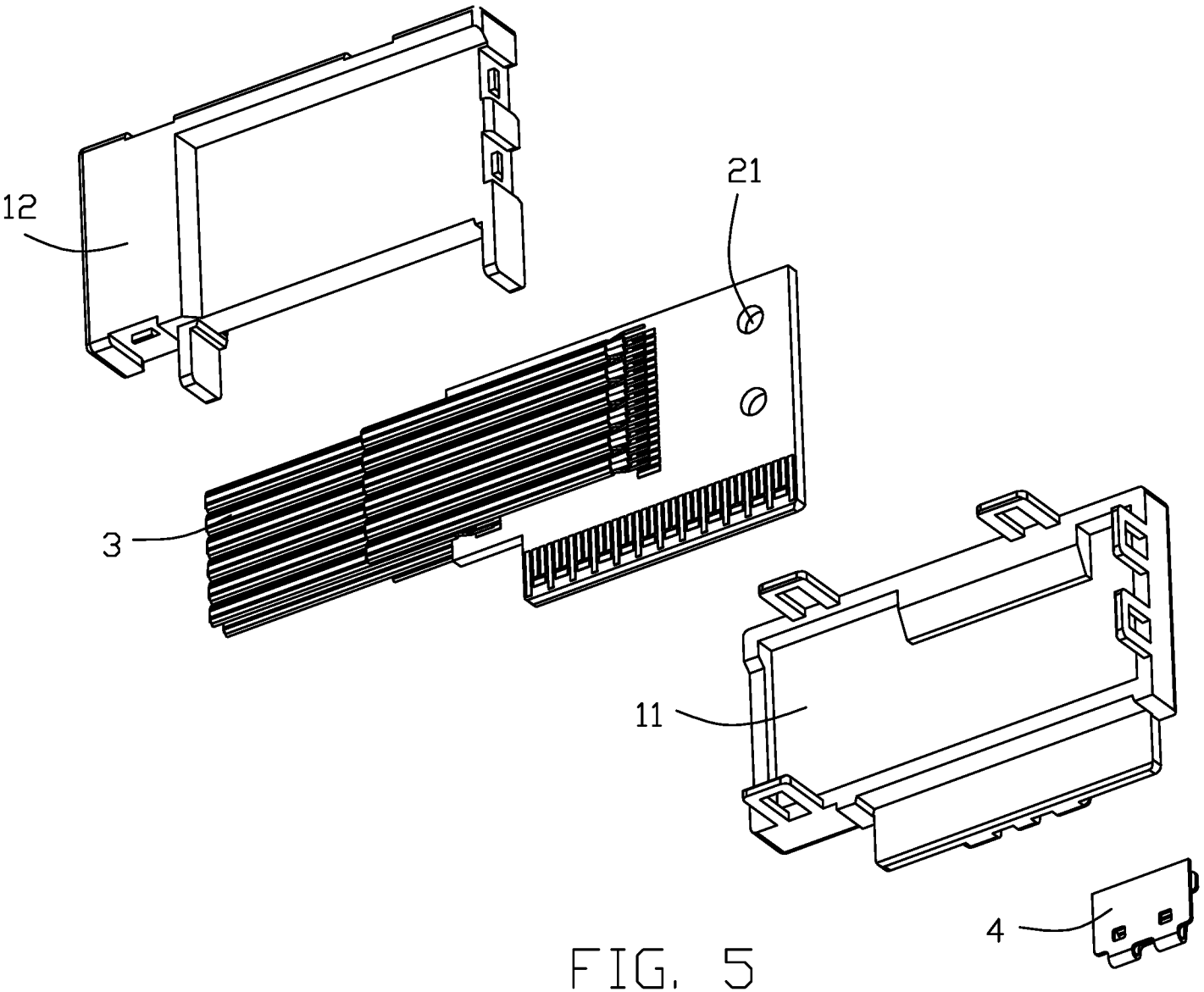
FIG. 5 is another exploded view of the plug connector as shown in FIG. 4.
Figure 6:
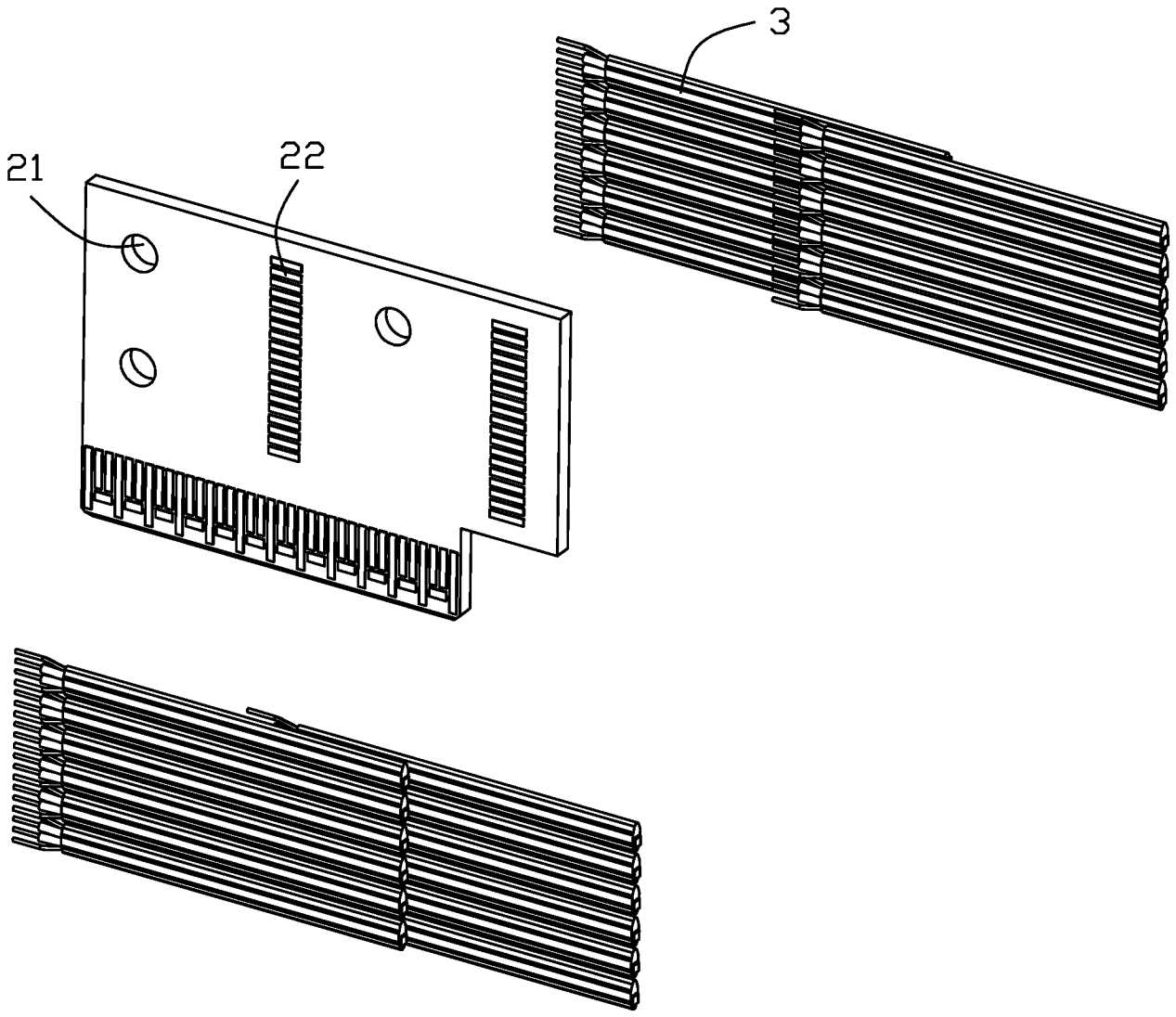
FIG. 6 is a partially exploded view of the plug connector is mated with the receptacle connector as shown in FIG. 4.
Figure 7:
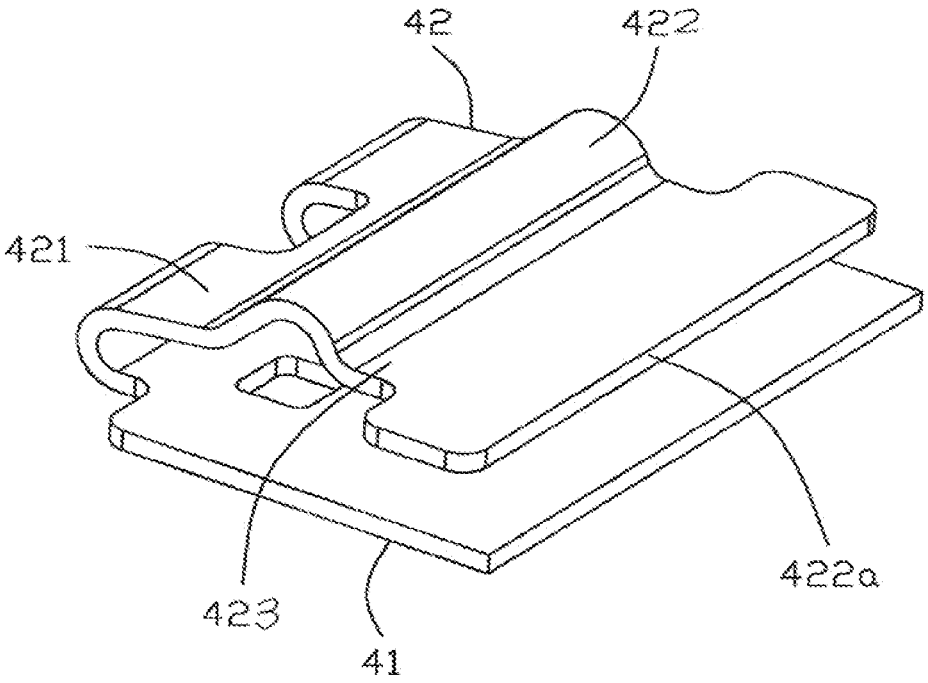
FIG. 7 is another exploded view of the plug connector as shown in FIG. 6.

Reference will now be made in detail to the embodiments of the present disclosure.

Referring to FIGS. 1-9, a plug connector 100 according to the present invention used for mating with receptacle connector 200. The plug connector 100 includes a shell 1, a printed circuit board 2 received in the shell 1, a cable 3 electrically connected with the printed circuit board 2 and a locking spring 4.

The shell 1 includes an upper casing 11 and a lower casing 12 mated with the upper casing 11. The upper casing 11 includes protruding section 111 located in the mating end, a groove 112 located in the other end opposite to the mating end, a plurality of protruding ribs 113 between the protruding section 111 and the groove 112, and clips 114. The protruding section 111 locates on both sides of the locking spring 4 and hold the locking spring 4. The protruding ribs 113 are arranged along the mating direction, and fingers can press there to increase the friction force, which facilitates the plug connector 100 to be inserted and removed. The lower casing 12 includes limiting portions 121 extending along the mating direction, positioning posts 122 at the front end of the lower casing 12, a step portion 123 at the rear end of the lower casing 12, and projections 124 cooperates with the clips 114. The limiting portions 121 are located on both sides of the printed circuit board 2 to prevent the plug connector 100 from being inserted obliquely during the mating process with the receptacle connector 200, thereby reducing the risk of PIN collapse.

The printed circuit board 2 includes mating holes 21 aligned with the positioning posts 122 and a plurality of soldering pads 22 on the front and back sides. The positioning posts 122 pass through the mating holes 21 to abut the rear end of the upper casing 11 to fix the printed circuit board 2, and improve the fitting accuracy of the plug connector 100 and the receptacle connector 200. The soldering pads 22 are arranged in two rows on the left and right sides, and the soldering pads 22 on both sides of the circuit board 2 are aligned in front and back direction, which is beneficial to the unification of the process standard of the plug connector 100.

The cable 3 is electrically connected to the soldering pads 22 of the printed circuit board 2 in a left-right direction perpendicular to the mating direction and extends in the horizontal direction.

Figure 8:
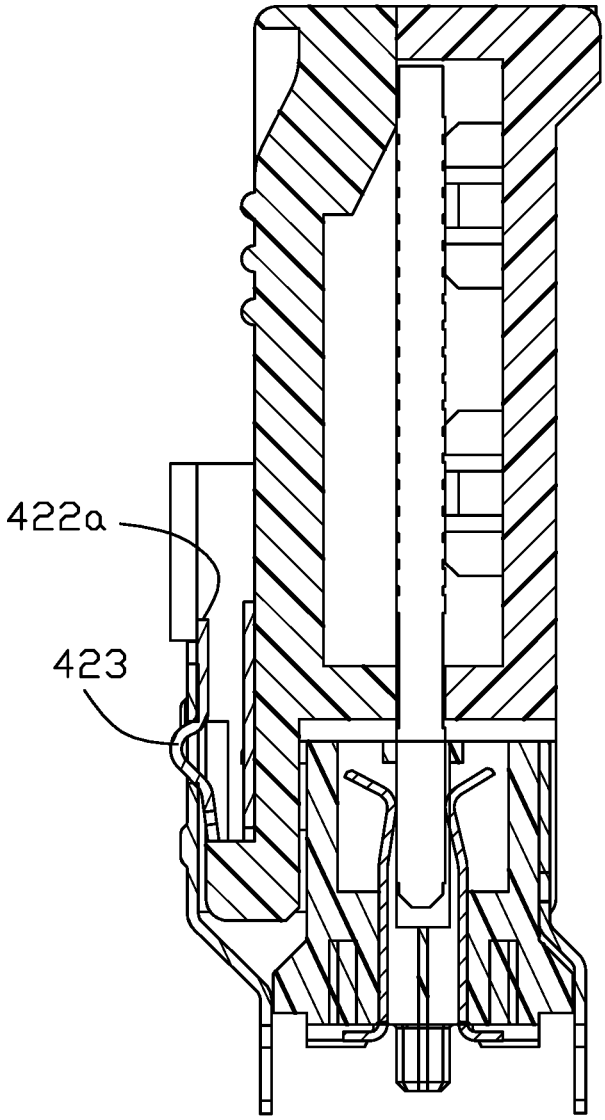
FIG. 8 is a cross-sectional view of the plug connector is mated with the receptacle connector taken along line 8-8 in FIG. 1.
Figure 9:
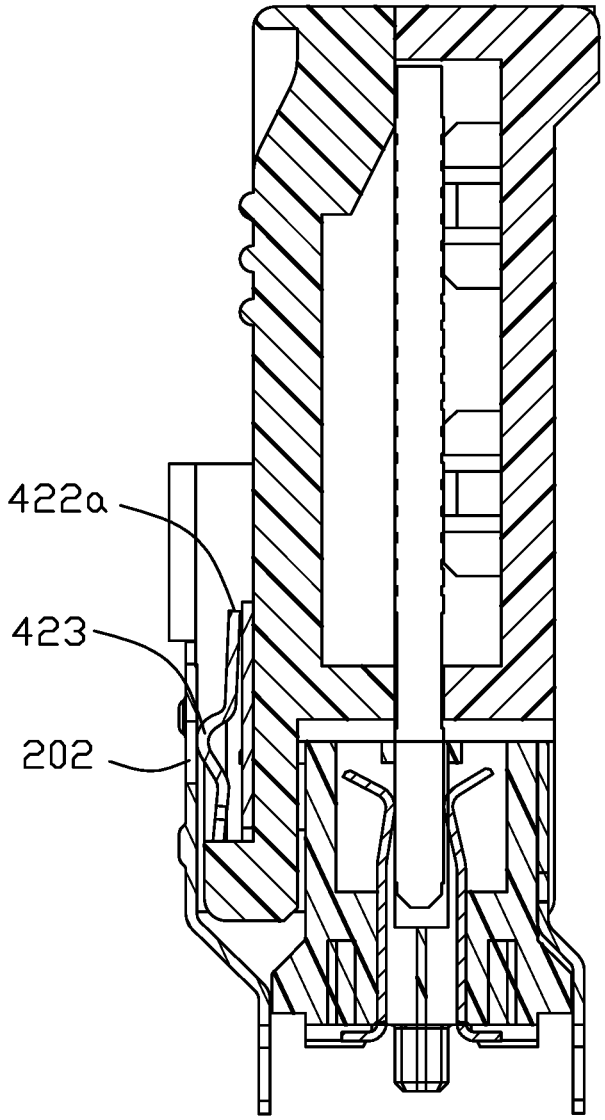
FIG. 9 is a cross-sectional view of the plug connector exiting the receptacle connector taken along line 8-8 in FIG. 1.

The locking spring 4 mounted on the upper casing 11 includes a stationary holding portion 41 held between the protruding sections 111 and a deflectable mating curved surface or locking portion 42, wherein the mating curved surface 42 allows the plug connector 100 and the receptacle connector 200 can be directly locked and inserted to unlock and pull out. The mating curved surface 42 includes an insertion curved surface 421 extending upward from the holding portion 41, a protruding portion 422 located at the topmost end, and an exit curved surface or locking protrusion 423 extending downward from the protruding portion 422. The insertion curved surface 421 forms an insertion angle, and the exit curved surface 423 forms a withdrawal angle. The receptacle connector 200 is provided with a socket shell 201 enclosing the insulative housing (not labeled) with a plurality of contacts (not labeled) therein by two sides of a receiving slot (not labeled) which receives the bottom mating edge of the printed circuit board 2, and a receiving groove 202 located on the socket shell 201. The receiving groove 202 is used for receiving the protruding portion 422. As shown in FIG. 8, when the plug connector 100 is mating with the receptacle connector 200, the locking spring 4 is deformed by the socket shell 201 and is depressed by inserting the curved surface 421 until the protruding portion 422 of the latch spring 4 is located in the receiving groove 202, the latch spring 4 rebounds upward to return to the normal state, and the mating process of the plug connector 100 and the receptacle connector 200 is completed. As shown in FIG. 9, when the plug connector 100 exits the receptacle connector 200, the latch spring 4 is deformed by the depression of the socket housing 201 through the exit surface 423 until the plug connector 100 and the receptacle connector 200 separate, and the locking spring 4 rebounds upward to return to the normal state. In this embodiment, the shell 201 of the receptacle connector 200 further includes a recess 203 in an upward edge. Correspondingly, the protruding section 111 of the shell 1 of the plug connector 100 further form a pair of restraining bars 117. During mating, the lower portions of the restraining bars 117*b* are received within the recess 203 while the upper portions 117*a* of the ribs 117 are exposed outside of the recess 203. The free end 422*a* of the protruding portion 422 does not extend beyond the pair of restraining bars 117 in both the vertical direction and the transverse direction so as not to be inadvertently actuated by an unexpected external piece, thus assuring reliable mating between the plug connector 100 and the receptacle connector 200. In this embodiment, the dimension of the receiving groove 202 of the shell 201 of the receptacle connector 200 and the corresponding exit curved surface 432 of the lock spring 4 are dimensioned with around one third of the length of the receptacle connector 200 in the longitudinal direction along which the cable 3 extends, thus assuring the required retention force between the plug connector 100 and the receptacle connector 200. Understandably, the mating curved surface allows the so-called passive latch operation for either insertion or withdrawing in response to the movement of the shell of the plug connector, compared with the active latch operation requiring the manual operation applied upon the deflectable locking spring directly.

What is claimed is:

1. An electrical connector assembly comprising:

a plug connector for mating with a receptacle connector and including a shell and therein a vertical printed circuit board extending along a vertical direction with a bottom edge for mating, and a cable connected to a rear region of the printed circuit board and extending along a longitudinal direction perpendicular to the vertical direction;

a pair of restraining bars formed on the shell;

a metallic locking spring secured to the shell and between the pair of restraining bars in the longitudinal direction, the locking spring forming a cantilevered deflectable locking portion moveable in a transverse direction perpendicular to both the vertical direction and the longitudinal direction; wherein a free end of the deflectable locking portion does not extend beyond the pair of restraining bars in both the vertical direction and the transverse direction; and the locking protrusion forms a curved surface for allowing deflection of the locking portion in response to an upward or downward movement of the shell with respect to the receptacle connector.

2. The electrical connector assembly as claimed in claim 1, wherein the deflectable locking portion forms a locking protrusion protruding in the transverse direction and extending uninterruptedly along the longitudinal direction.

3. The electrical connector assembly as claimed in claim 2, wherein a dimension of the locking protrusion along the longitudinal direction is around one third to one fourth of a length of the bottom edge of the printed circuit board in the longitudinal direction.

4. The electrical connector assembly as claimed in claim 3, wherein the receptacle connector includes a metallic socket shell forming an uninterrupted receiving groove to receive the locking protrusion during mating, and said receiving groove is dimensioned around one third of the socket shell along the longitudinal direction.

5. The electrical connector assembly as claimed in claim 4, wherein said socket shell further includes a recess in an upper edge, and said recess only receives lower parts of the pair of restraining bars while exposing upper parts of the pair of restraining bars.

6. An electrical connector assembly comprising:

a plug connector including:

a shell enclosing a printed circuit board with thereof a mating edge extending along a first direction;

a pair of restraining bars formed on the shell and spaced from each other in the first direction;

a metallic locking spring retained to the shell and including a deflectable locking portion back and forth moveable in a second direction perpendicular to the first direction and restrained between the pair of restraining bars in the first direction, said locking portion forming thereon a locking protrusion protruding in the second direction and extending along the first direction; and a receptacle connector adapted to be mated with the plug connector in a third direction perpendicular to both the first direction and the second direction, the receptacle connector including:

an insulative housing defining a receiving slot for receiving the mating edge of the plug connector, and a plurality of contacts disposed by two sides of the receiving slot;

a metallic shell enclosing the housing and forming a receiving groove for receiving the locking protrusion, and a recess in an edge; wherein an upper free end of the deflectable locking portion does not extend above the pair of restraining bars in the third direction.

7. The electrical connector assembly as claimed in claim 6, wherein the pair of restraining bars are received within the recess.

8. The electrical connector assembly as claimed in claim 7, wherein only a portion of the pair of restraining bars are received within the recess in the third direction.

9. The electrical connector assembly as claimed in claim 6, wherein said upper free end of the deflectable locking portion does not extend beyond the pair of restraining bars in the second direction.

* * * * *